US006854924B2

(12) United States Patent
Ring

(10) Patent No.: US 6,854,924 B2
(45) Date of Patent: Feb. 15, 2005

(54) LIQUID DRAINAGE UNIT

(75) Inventor: Carl D. Ring, Oakland, TN (US)

(73) Assignee: Ring Industrial Group, L.P., Oakland, TN (US)

( * ) Notice: Subject to any disclaimer, the term of this patent is extended or adjusted under 35 U.S.C. 154(b) by 0 days.

(21) Appl. No.: 10/253,811

(22) Filed: Sep. 25, 2002

(65) Prior Publication Data

US 2004/0057797 A1 Mar. 25, 2004

(51) Int. Cl.[7] ..... G02B 11/00
(52) U.S. Cl. ..... 405/45; 210/170
(58) Field of Search ..... 405/43, 45, 156, 405/157; 210/170

(56) References Cited

U.S. PATENT DOCUMENTS 4,983,068 A * 1/1991 Kozak et al. ..... 405/36
5,015,123 A 5/1991 Houck et al. ..... 405/45
6,173,483 B1 1/2001 Houck et al. ..... 29/407.09
6,527,477 B1 * 3/2003 Allard ..... 405/45
6,551,023 B2 * 4/2003 Allard ..... 405/36
6,705,800 B2 * 3/2004 Ring et al. ..... 405/46

OTHER PUBLICATIONS

"Helping the World Move Water", HDPE Drainage Products, Advanced Drainage Systems, Inc.—2 pages.

* cited by examiner

*Primary Examiner*—Thomas B. Will
*Assistant Examiner*—Tara L. Mayo
(74) *Attorney, Agent, or Firm*—David A Tamburro

(57) ABSTRACT

A pre-assembled drainage line unit includes a flexible longitudinally extending perforated sleeve member and a loose aggregation of lightweight elements contained within the sleeve member. A pliable, water permeable barrier material extends along the sleeve member and overlies at least a portion of the aggregation to prevent the passage of solid materials, such as sand and dirt, into the aggregation.

14 Claims, 3 Drawing Sheets

LIQUID DRAINAGE UNIT

BACKGROUND OF THE INVENTION

This invention relates generally to liquid drainage systems used on site for footings, open trenches, or nitrification fields used as discharge points for septic tanks, and more particularly to a novel flexible preassembled drainage line unit which is an improvement over the flexible preassembled drainage line units illustrated in FIGS. 2 and 3 of U.S. Pat. No. 5,015,123 (the "'123 patent", owned by the assignee of this invention), the disclosure of which is incorporated herein by reference in its entirety.

The preassembled drainage line unit illustrated in FIG. 2 of the '123 patent constitutes loose aggregate in the form of lightweight materials such as polystyrene beads provided in surrounding relationship to a perforated conduit and bound thereto by a perforated sleeve member such as plastic netting. These units, used in combination with preassembled units illustrated in FIG. 3 of the '123 patent which do not include the perforated pipe, provide a storage chamber or area for example for effluent from a septic tank until it can be absorbed by the surrounding soil as illustrated in FIGS. 4*b* and 4*c* of the patent and replaces the conventional gravel drainage system illustrated in FIG. 1 of the patent. Drainage systems employing the preassembled drainage line units of the '123 patent represent a substantial improvement over prior conventional gravel systems for reasons set forth in the '123 patent and have enjoyed substantial commercial success.

While those preassembled drainage line units have enjoyed commercial success, in certain applications problems have presented themselves. For example depending on the type of fill soil placed on top of the preassembled units, solids such as sand or dirt may pass downwardly through the netting into the void area between adjacent aggregate, clogging that area and causing an undesirable reduction in liquid flow through the aggregate. In other applications it is sometimes desirable that the pre-assembled units which are normally very flexible along their length possess greater rigidity along that length and still in other applications it is sometimes beneficial to provide structure as part of those units which promotes the growth of microorganisms within the drainage units.

The improved drainage products of the invention as described hereinbelow have been developed to overcome the problems associated with the units described in the '123 patent and to fulfill the needs described above.

SUMMARY OF THE INVENTION

Accordingly, a primary object of the invention is to provide a preassembled drainage line unit in which loose aggregate in the form of lightweight materials is contained within and bounded by a perforated conduit such as a plastic mesh tube of construction netting and wherein a barrier material overlies at least a portion of the aggregate to prevent solids from passing through the netting and entering the storage area defined by the aggregate.

Another object of the invention resides in the provision of the above novel preassembled drainage unit which further includes a perforated conduit wherein the loose aggregate surrounds the conduit and is bounded thereby by the perforated sleeve member.

Depending upon the type of drainage application in which the novel preassembled units are to be used, the material from which the barrier is constructed may vary. For example, it may be paper, cloth, geo-textile such as nylon, or any other suitable pliable sheet material that can be inserted between the netting and the aggregate. The thickness of the sheet material can be varied. For example the thickness of the material may be thin so as to conform to the preferred cylindrical shape of the units or may be thicker to provide rigidity along the length of the units. In addition, the barrier material may extend around the aggregate through an angular distance of about 10 degrees through full coverage of 360 degrees.

The provision of the barrier material within the above described novel preassembled drainage units can be tailored to block the infiltration of outside media such as sand, dirt and soil through the net into the aggregate, to provide rigidity to the drainage units along their length and to provide structure which promotes the growth of microorganisms within the drainage unit.

It is also an object of the invention to provide a method and apparatus for manufacturing the novel drainage units.

Further objects and advantages of the invention will become evident from the reading of the following detailed description of the invention wherein reference is made to the accompanying drawings.

DETAILED DESCRIPTION OF THE INVENTION

Figure 1:
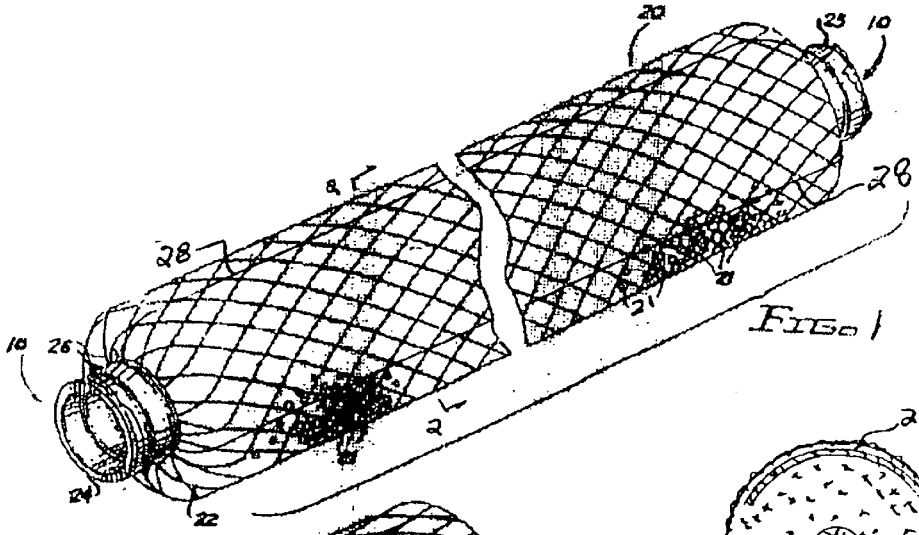
FIG. 1 illustrates a preassembled drainage line unit constructed according to the invention which includes a plurality of lightweight aggregate surrounding a perforated conduit and bounded thereto by an outer perforated sleeve member, with a barrier material overlying at least a portion of the aggregate to prevent outside media such as sand, dirt or soil from infiltrating into the liquid storage area defined by the aggregate.

Referring now to the drawings, the longitudinally extending, flexible preassembled drainage line unit 20 illustrated in FIG. 1 includes a corrugated VC (polyvinyl chloride) perforated vent pipe 10 encased by an outer perforated sleeve member 22 of tubular nylon netting or mesh which is filled with an aggregation of discrete water impervious crush resistant lightweight plastic elements 21 and is secured to the pipe ends 24 and 25 by means of suitable conventional wires or tie fasteners 26 which prevent the escape of the loose aggregates 21.

Figure 2:
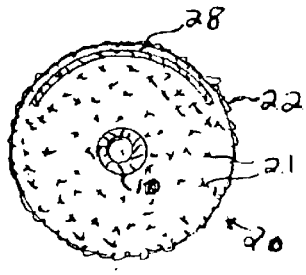
FIG. 2 is a cross-sectional view of the unit taken along line 2—2 of FIG. 1.

Unit 20 as described thus far corresponds to the drainage unit illustrated in FIG. 2 in U.S. Pat. No. 5,015,123 and the detailed description set forth therein is incorporated herein by reference.

As mentioned hereinabove, in some applications employing the flexible drainage line units illustrated in the '123 patent, outside media solids such as sand, dirt or local soil placed on top of the units can penetrate into the units and thereby reduce the void space between the aggregates 21, clogging the units and reducing the fluid flow through the units.

To alleviate this problem a liquid or water permeable barrier material 28 is placed between aggregates 21 and netting 22, the barrier 28 extending longitudinally along unit 20 between ends 24 and 25 of the pipe and being secured at its ends to the pipes by fasteners 26 along with the netting 22.

As shown n FIG. 2 the barrier 28 extends through a predetermined desired angular distance across the top portion of unit 20 and depending upon the application it may extend through an angular distance within the range of 10 degrees to a complete 360 degrees of the unit.

Barrier 28 may be constructed of any suitable pliable water permeable sheet material such as paper or cloth, but is preferably a geo-textile material such as nylon having a fine weave to block the passage of the sand or dirt but sufficiently open to permit the passage of water therethrough.

Preferably barrier 28 is very thin so as to readily conform to the shape of the flexible unit 20 which is preferably generally cylindrical but it may be thickened as desired to provide rigidity to the unit if desired.

In operation water collected at one end of pipe 10 passes into the pipe and outwardly through the perforations of the pipe into the chamber defined by aggregates 21 and barrier 28 blocks infiltration of sand or dirt placed on top of units 20 into the void space containing the aggregates.

Figure 3:
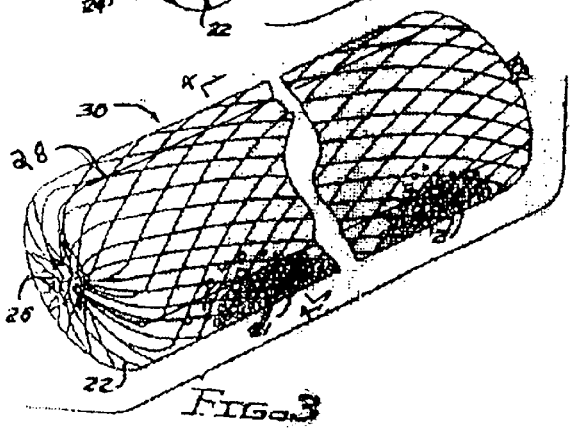
FIG. 3 illustrates a preassembled drainage line unit similar to FIG. 1 with the perforated conduit removed.

Referring now to FIG. 3 the generally cylindrical drainage unit 30 is the same as unit 20 described in FIG. 1 except that it has no conduit passing therethrough. The end of the netting 22 and barrier 28 are tied together at the ends of unit 30 to hold aggregates 21 in place within the units. The units illustrated in FIG. 3 in this application containing the barrier 28 constitute an improvement over the conduitless units illustrated in FIG. 3 of the '123 patent and described therein.

Figure 5:
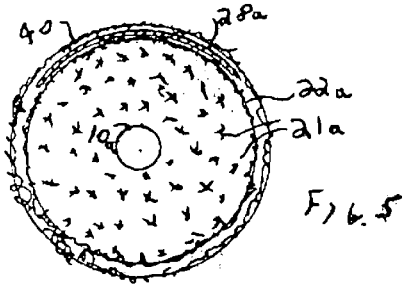
FIG. 5 is a cross-sectional schematic view illustrating an alternative construction of the unit illustrated in FIG. 1.

FIG. 5 an alternative construction to that illustrated and described above with respect to FIG. 1. In the FIG. 5 embodiment, a pipe 10*a* is surrounded by aggregate 21*a* which is bounded to the pipe by a first perforated net 22*a*, with this structure described so far being essentially identical to the prior art unit illustrated in FIG. 2 of the '123 patent. A barrier 28*a* extends longitudinally along the length of the unit outside of net 22*a* and around the unit through a predetermined angular distance and is fastened thereto by suitable means such as a second outer tubular nylon net or mesh 40 fastened at its ends along with the ends of barrier 28*a* to the ends of pipe 10 in the same manner as the unit of FIG. 1. Instead of the tubular net 40, barrier 28*a* may, for example, be fastened to the outside surface of net 22*a* by rope or cord at various locations along the length of the unit.

Figure 4:
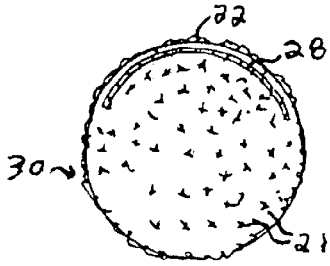
FIG. 4 is a cross sectional view of the conduitless unit taken along line 4—4 of FIG. 3.

Another embodiment constructed according to FIG. 5 but without the conduit 10*a* may be provided as an alternative to the conduitless unit illustrated in FIGS. 3 and 4.

From the description herein above it is apparent that the provision of the barrier 28 in the preassembled drainage line units advantageously prevents the passage of outside media such as sand, dirt or soil into the void space defined by the lightweight plastic aggregates; the barrier provides structure for the growth of microorganisms within the drainage unit; and the barrier may be constructed to provide rigidity to the unit when desired. The flexible pliable barrier material may extend a varying angular distance around the unit. For example, it may extend through a small angular distance of about 10 degrees to full circumferential coverage of 360 degrees of the unit depending upon the application in which the unit is to be used.

Figure 6:
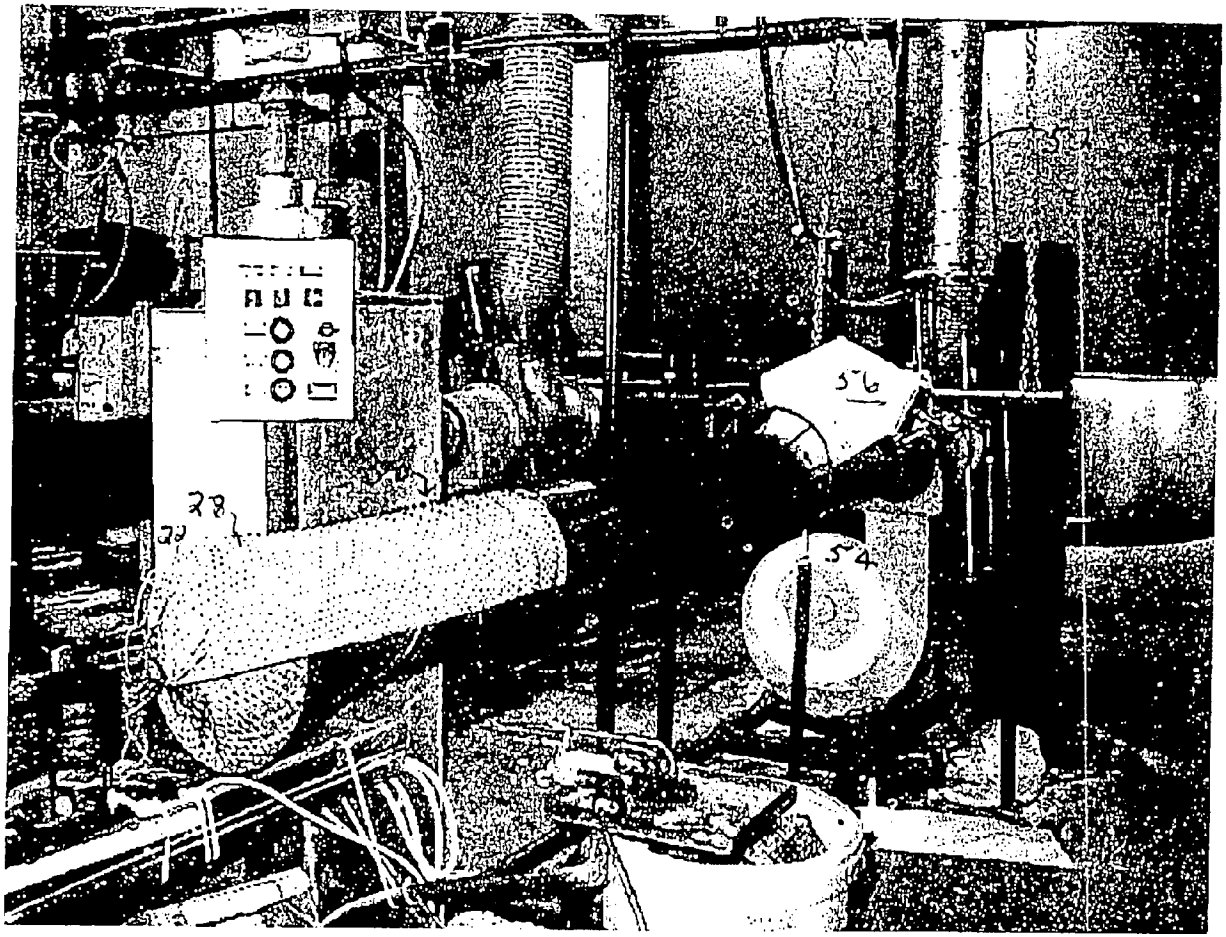
FIG. 6 is a fragmentary front perspective view of apparatus for manufacturing the novel drainage units of the invention.
Figure 7:
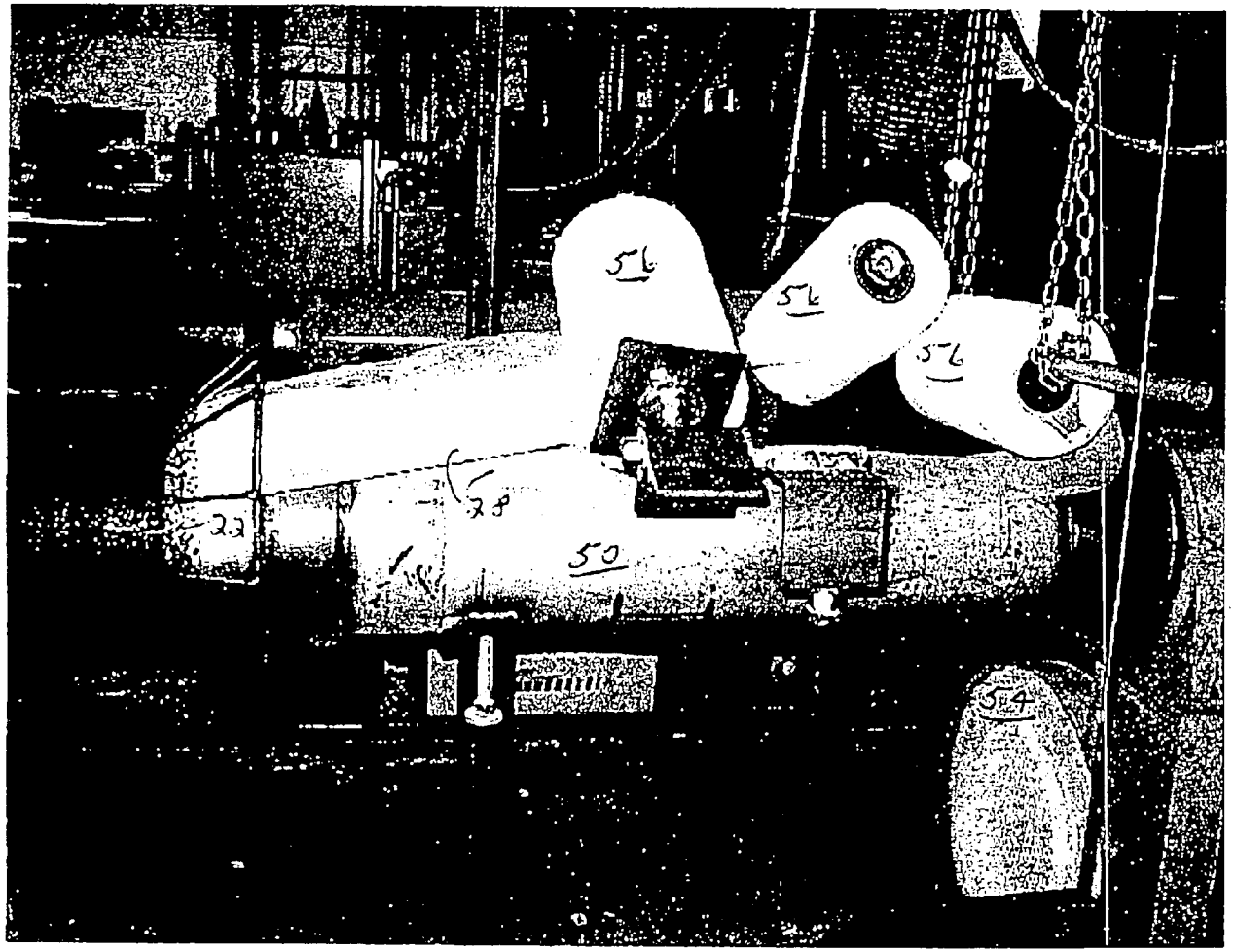
FIG. 7 is a side view of the apparatus of FIG. 6 illustrating the manner in which the rolls of barrier material are supported on the mandrel.

The apparatus shown in FIGS. 6 and 7 is of the type illustrated and described in detail in U.S. Pat. No. 6,173,483 which is owned by the assignee of this application, and the disclosure of U.S. Pat. No. 6,173,483 is incorporated herein by reference in its entirety. The apparatus is used to make both of the units of FIGS. 1 and 2.

Briefly, the apparatus includes a tubular mandrel 50 having an inner bore or cavity, a rear opening, a front opening, and an upper opening, with each opening communicating with the inner cavity.

A pipe feeder is positioned for feeding a predetermined length of perforated length pipe through the inner cavity of the mandrel 50 in a direction of manufacture from the rear opening to the front opening and therethrough. As it is fed into the mandrel 50 the vent pipe is positioned within the inner cavity so as to define a void space between the pipe and the inner wall of the mandrel.

A hopper assembly containing the plastic aggregate bodies is connected via conduit 52 to the upper opening in the mandrel to feed the plastic aggregates into the cavity.

A blower 54 is positioned in communication with the inner cavity of the mandrel for producing the sufficient air flow therethrough for moving the aggregate from conduit 52 through the inner cavity to substantially fill the void space between the vent pipe and the wall of the mandrel so that the pipe is surrounded by the aggregate as it emerges from the from opening of the mandrel.

A sleeve feeder is connected to the front end of the mandrel for feeding a continuous sleeve of netting 22 over the plastic aggregate and the vent pipe emerging through the front opening of the mandrel. As it is fed the continuous sleeve of netting 22 substantially encases the plastic aggregate around the vent pipe thereby forming a drainage unit.

The apparatus operates substantially the same for producing the conduit units of FIG. 3 but with no perforated vent pipe being fed through the unit.

For a more detailed description of this type of apparatus, reference is made to the specification of U.S. Pat. No. 6,173,483.

In accordance with the invention one or more rolls 56 of barrier sheet material 28 are mounted on top of mandrel 50, the leading end 58 of which is located underneath the netting 22 in contact with the mandrel and is fed with the netting over the plastic aggregate and is fastened with the netting around the vent pipe for manufacturing the units of FIG. 1, or is simply tied together with the end of the netting for producing the conduitless units of FIG. 3. The apparatus as illustrated in FIGS. 6 and 7 is producing conduitless units. When drainage units larger in diameter for example, 10 inches, 12 inches, 14 inches, etc. are being produced instead of using a single roll 56 of barrier material it is better to use a plurality of rolls which are angularly offset as shown in FIGS. 6 and 7 with overlapping side edges so that the barrier material is able to extend for a larger angular distance, for example approximately 180 degrees in the unit shown in FIG. 6.

The operation illustrated in FIGS. 6 and 7 produces the units of FIGS. 1 and 2 and FIGS. 3 and 4 wherein the barrier material 28 is placed between netting 22 and aggregates 21.

To produce the embodiments illustrated in FIGS. 5 and 6, the operation of FIGS. 6 and 7 may be modified by placing the leading edges of barrier material 28 on top of the netting 22 on mandrel 50 and then placing a second netting 40 around barrier 28 and the first netting 22 and continue the operation as described above.

The invention may be embodied in other specific forms without departing from the spirit or essential characteristics thereof The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A preassembled drainage line unit comprising a longitudinally extending perforated sleeve member, a loose aggregation of lightweight plastic elements contained within said sleeve member, and barrier means extending longitudinally along said sleeve member and overlying at least a portion of said aggregation of elements to prevent the passage of solid materials into said aggregation of elements, said barrier means being located between said sleeve member and said aggregation of elements.

2. The preassembled drainage line unit of claim 1, further comprising a perforated conduit extending through said aggregation, said sleeve member enveloping said aggregation and bounding the same relative to said conduit.

3. The preassembled drainage line unit of claim 2, wherein said sleeve member is generally cylindrical and said barrier means overlies said aggregation of elements through an angular distance within the range of about 10 degrees to 360 degrees.

4. The preassembled drainage line unit of claim 1, wherein said sleeve member is generally cylindrical and said barrier means overlies said aggregation of elements through an angular distance within the range of about 10 degrees to 360 degrees.

5. The preassembled drainage line unit of claim 1, wherein said barrier means is water permeable.

6. The preassembled drainage line unit of claim 5, wherein said barrier means is constructed from pliable sheet material.

7. The preassembled drainage line in unit of claim 6, wherein said sheet material is selected from the group consisting of paper, cloth, and geo-textile.

8. A preassembled drainage line unit comprising a longitudinally extending perforated conduit, a loose aggregation of lightweight plastic elements surrounding said conduit, a generally cylindrical mesh tube of netting enveloping said aggregation and bounding the same relative to said conduit, the ends of said netting being respectively fastened about the ends of said conduit, and barrier means extending longitudinally along said tube of netting and overlying at least a portion of said aggregation of elements to prevent the passage of solid materials into said aggregation, said barrier means being located between said tube of netting and said aggregation of elements.

9. The preassembled drainage unit of claim 8, wherein said barrier means overlies said aggregation of elements through an angular distance within the range of about 10 degrees to 360 degrees.

10. The preassembled drainage unit of claim 8, wherein said barrier means is water permeable.

11. The preassembled drainage unit of claim 10, wherein said barrier means is constructed from pliable sheet material.

12. The preassembled drainage unit of claim 11, wherein said sheet material is selected from the group consisting of paper, cloth, and geo-textile.

13. A method of manufacturing a drainage line unit, the method including the steps of:

closing a forward end of a continuous sleeve of netting and of a barrier sheet material;

feeding the continuous sleeve of netting and the barrier sheet along a direction of manufacture with the barrier sheet located within the sleeve of netting;

feeding a plurality of loose aggregate into the sleeve of netting to substantially fill the space within the netting, the barrier sheet located between the sleeve of netting and the aggregate and angularly overlying at least a portion of the aggregate so as to prevent the passage of solids into the aggregate.

14. The method as defined in claim 13, wherein the forward ends of the netting and of the barrier are closed about a length of perforated pipe and are fed therewith along a direction of manufacture, the loose aggregate being fed into the space between the sleeve of netting and the pipe to substantially fill the space so that the pipe is surrounded by a plurality of aggregate.

* * * * *